United States Patent [19]

Judkins

[11] 4,028,767

[45] June 14, 1977

[54] FOLDABLE BRUSHES

[76] Inventor: Ren Judkins, P.O. Box 8342, Salt Lake City, Utah 84108

[22] Filed: Oct. 29, 1975

[21] Appl. No.: 620,126

[52] U.S. Cl. ..... 15/203
[51] Int. Cl.[2] ..... A46B 7/02; A46B 15/00
[58] Field of Search ..... 15/203, 195, 196, 201

[56] References Cited

UNITED STATES PATENTS

| | | | |
|---|---|---|---|
| 2,604,649 | 7/1952 | Stephenson et al. | 15/203 X |
| 2,871,494 | 2/1959 | Weyl | 15/203 X |

FOREIGN PATENTS OR APPLICATIONS

| | | | |
|---|---|---|---|
| 5,556 | 3/1891 | United Kingdom | 15/203 |

*Primary Examiner*—Richard E. Aegerter
*Assistant Examiner*—Richard R. Stearns

[57] ABSTRACT

A brush composed of slim rectangular segments hinged together at their edges with bristles protruding from the hinged edges such that when the segments are folded together accordion style the bristles stick out for brushing. Simultaneously the segments act as a backing and grip. When the segments are unfolded, oriented edge to edge, the bristles interdigitate flush against the segments leaving the entire brush thin, flat, flexible, and easily stored or carried, e.g. as in a pants pocket or purse.

Furthermore, a covering can be affixed so that it covers the bristles of the brush when it is in a flat or storage mode (configuration). This covering can be very thin and flexible or segmented and hinged in such a way as to enable it to function as a handle to the brush when the brush is in the folded or brushing mode (configuration).

6 Claims, 6 Drawing Figures

FOLDABLE BRUSHES

BACKGROUND OF THE INVENTION

1. Field of the Invention

This is a type of brush having plural tuft sections hinged together and an optional protective cover when not in use.

2. Description of Prior Art

In the past, hair brushes with longer bristles, whether foldable or not, were too bulky and rigid for carrying neatly in a bag, case, or pocket.

BRIEF SUMMARY OF INVENTION

The object of this invention is to create a brush that unfolds into a thin, flat, flexible shape for storing or carrying more conveniently and also to provide a covering to shield the bristles of the brush when not in use. This is accomplished by setting the bristles in separate segments of backing which are hinged together so that they can be folded and unfolded fan (accordian) style exposing the bristles for use or laying them away for storage. The covering can be thin and flexible or segmented in the same manner as the brush. In either case the covering would be connected to the brush in such a way that it would cover the bristles when the brush was unfolded flat and fold up out of the way of the bristles when the brush was folded for use. The cover may also act as a handle when the brush is folded for use.

DETAILED DESCRIPTION OF INVENTION

Figure 1:
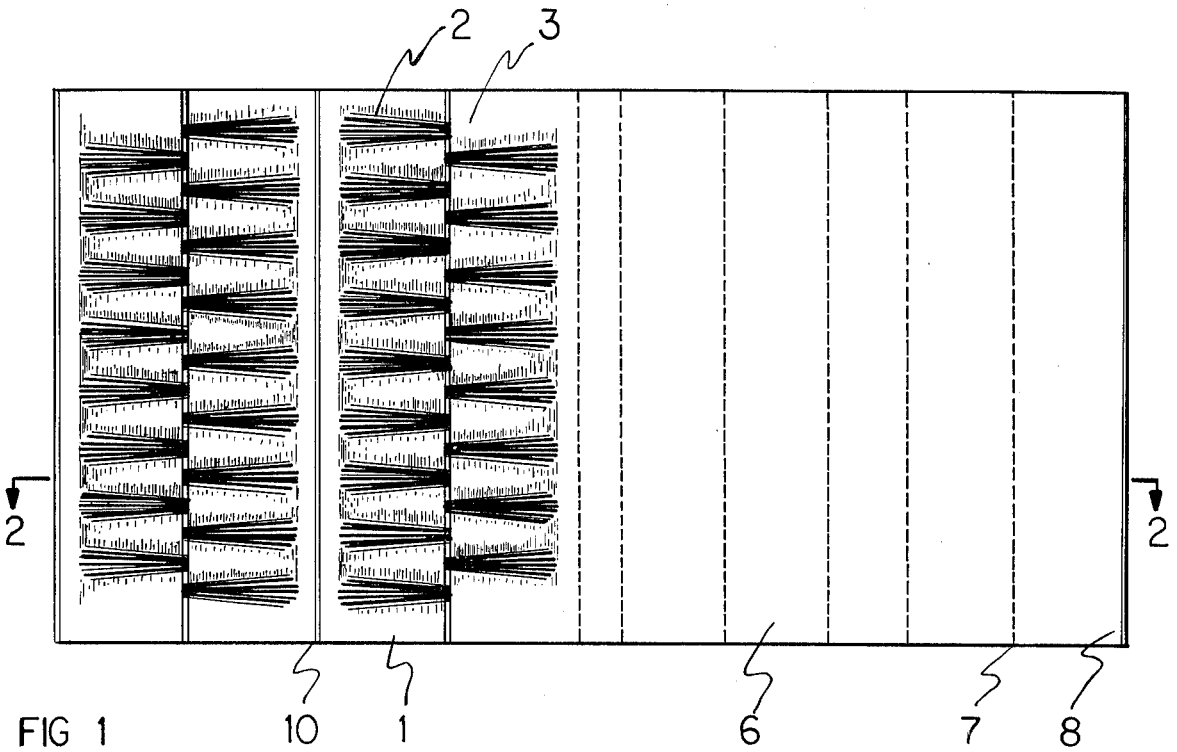
FIG. 1 shows a brush with a thin covering in the "flat" mode except with the covering swung to the side to expose the bristles.

The minimum structure consists of two flat segments hinged together, each segment serving as a backing for bristles (or tufts of bristle), which run the length of and are mounted in at least one edge of each segment. The bristles 2 or 5 are set into the hubs 3 which are interspaced with depressions 4 so that the bristles of both segments can interdigitate when the segments are oriented in the same plane. I shall call this orientation the "flat" mode (FIG. 1, 3, 6) as opposed to the "stacked" mode (FIG. 2, 4, 5) where the segments are fan folded (accordian style) and the bristles stand free for brushing use.

By varying the number of bristle segments 1, the type of bristles, the edges the bristles are mounted on, and adding a covering or other modification, many brushes for different uses can be generated from this minimum structure. I have diagrammed some preferred examples of hair brushes. These are not intended to limit the invention, but to illustrate it.

The examples try to demonstrate how many variations are possible with the alternatives inherent in the basic idea. One example has only tufts of bristles 2, while another has both bristle tufts and plastic fingers 5. The later has bristles mounted on both hinged edges of the two center segments, whereas the former has bristles mounted on only one edge of each bristle segment.

Figure 2:
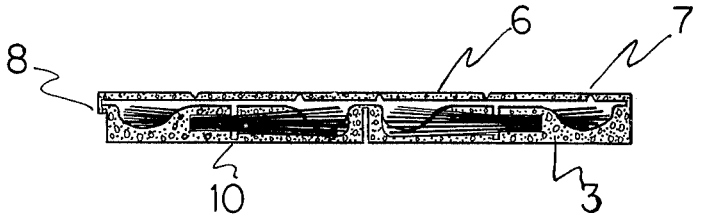
FIG. 2 is a cross section of the brush in FIG. 1 taken at line 2—2. However, the covering is swung back over the bristles to the normal position for the "flat" mode.
Figure 3:
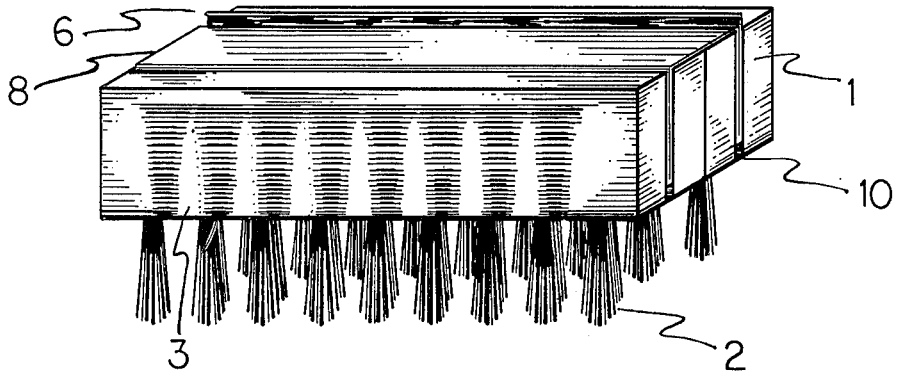
FIG. 3 is an oblique cabinet view of the brush in FIG. 1 in the "stacked" (folded) mode.

I have shown two basic types of coverings. The "thin" covering 6 is flexible and/or foldable. It is connected to the bristle segments so that it overlays the bristles when the brush is in the flat mode and folds away as part of the grip when the brush is in the stacked mode. A particular covering of this type is shown in FIGS. 1, 2, & 3. The covering is connected to an edge parallel to the hinged edge of outside bristle segment and is tucked away between the folds of the bristle segments when in the stacked mode, FIG. 2. The dotted lines 7 in FIG. 1 show where the covering is folded in the stacked mode.

When in the flat mode the covering may have a plastic ridge snap 8 or other means to secure the free end of the covering over the bristles.

Figure 4:
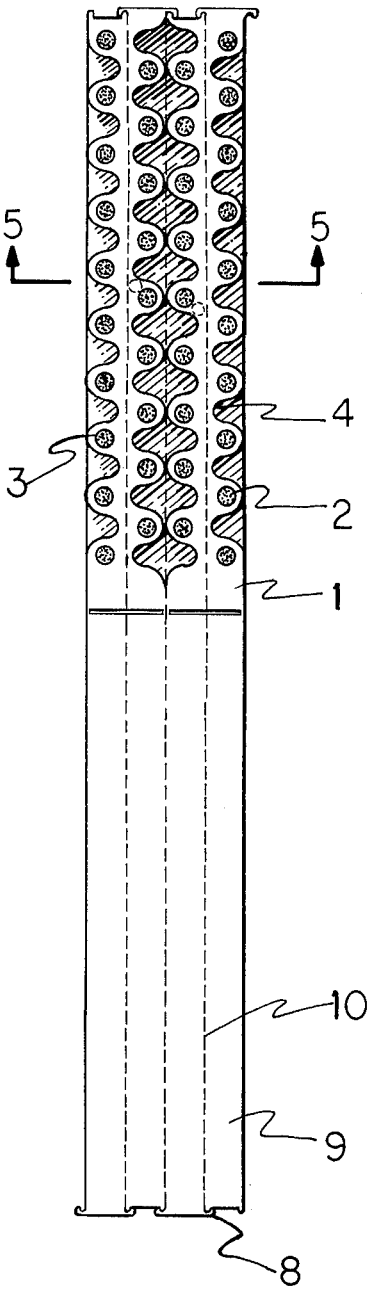
FIG. 4 shows a different brush with a segmented covering and additional plastic finger bristles. It is in the "stacked" mode.

The second basic covering shown is composed of segments similar to the bristle segments in dimensions. These cover segments 9 are connected to the bristle segments in such a way that the hinged edges of both are in line and the covering can cover the bristles when in the flat mode. In the stacked mode the covering segments 9 form an adjacent stack which can be used as a handle for the brush (FIG. 4). The covering may have some means to secure it over the bristles when in the flat mode. FIG. 4 shows a ridge-snap 8 for securing the cover segments to the bristle segments and also secure the bristle cover segments tightly to themselves when the brush is in the stacked mode. FIG. 4 also shows two dashed circles on and near the line 5—5. These circles are representative of the relative positions of the two rows of plastic fingers shown in FIGS. 5 & 6 but hidden in this view.

Figure 5:
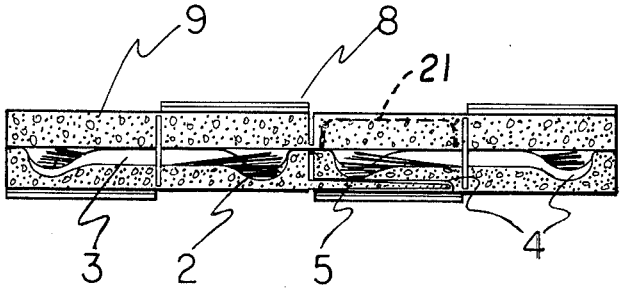
FIG. 5 is a cross section view of the brush of FIG. 4 except in the "flat" mode. The section is taken at line 5—5.
Figure 6:
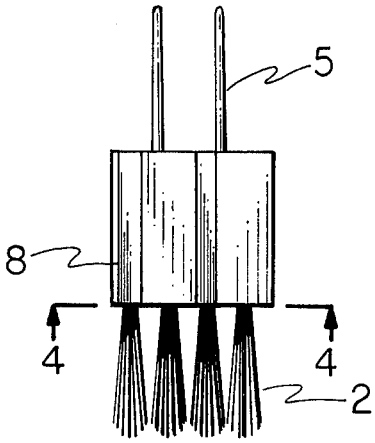
FIG. 6 is an end-on view of the brush in FIG. 4, it is also in the stacked mode. Finally, the names of the parts denoted by numbers in the drawings are as follows: 1 bristle segments, 2 bristle tufts, 3 hubs for bristles, 4 depressions for bristle to lie in, 5 plastic finger bristles, 6 thin covering, 7 folding marks or hinges, 8 plastic ridge snaps, 9 cover segments, 10 hinges.

Since the cover segments in FIGS. 4, 5, 6 must be the same thickness as the bristle segments to fold in conjunction with them, there is available space 21 (shown in broken lins, FIG. 5) within their dimensions to use for other accessories. Makeup, such as mascara, lipstick, eye shadow, perfume, etc. packaged in containers of suitable dimensions is one possibility for utilizing these spaces 21. The containers could snap into hollows formed into the cover segments. Barrettes, elastics, hair care products, or personal hygiene products like fingernail files and tweezers are other possibilities. What particular accessories are used to fill this available space 21 would depend upon the particular use the brush in intended for. Since there is a broad range of alternative uses of the basic brush there is also a large gamut of possible accessories which could be fitted into the cover segments.

Both examples are preferably constructed of plastic capable of forming durable hinges in a single molded piece when thin lines of plastic completely separate different areas, e.g. as the segments are separated. Other materials are, of course, possible, with hinges suited to their characteristics.

I claim:

1. A collapsible brush comprised of a plurality of rectangular segments in which the thickness of the edges is smaller than the width and also the length of the faces; means to articulate said segments such that said segments can be fan folded (accordian) face to face in a stack and unfolded edge to edge; bristle tufts mounted in at least one adjacent edge of each segment, said bristle tufts staggered with respect to the bristle tufts extending from the edge of the adjacent segment; a plurality of hollow depressions formed in at least one face of each segment, the depressions being adapted to receive the bristle tufts of an adjacent segment when the brush is unfolded.

2. A collapsible brush as defined in claim 1 further comprising a thin flexible covering joined to a nonadjacent edge of one of the segments, the covering being large enough to cover essentially all of the bristle tufts when the brush is unfolded, said covering also being flexible enough to wrap around the stacked segments when the brush is in use.

3. A collapsible brush as defined in claim 1 further comprising a thin flexible covering joined to a nonadjacent edge of one of the segments the covering being large enough to cover essentially all of the bristle tufts when the brush is unfolded, said covering having fold lines to accommodate being tucked in between the stacked segments when the brush is in use.

4. A collapsible brush as defined in claim 1 further comprising a cover/handle combination joined to the collapsible brush, said combination comprising: a plurality of segments corresponding in width and thickness to the segments of the brush and articulated in the same manner as the brush, means to join said segments to the brush such that the segments can be swung onto the top of the brush when it is unfolded thereby covering the bristles and swing into an open position wherein the articulated edges of said segments align longitudinally with the articulated edges of the brush segments accommodating fan folding in unison of the cover/handle segments and the brush segments, the stack formed by the fan folded cover/handle segments serves as a handle for the collapsible brush when said brush segments and cover/handle segments are stacked.

5. A cover/handle as defined in claim 4 comprising hollow compartments formed in the cover/handle segments, said compartments accommodating storage of cosmetic and brush accessories.

6. A collapsible brush as defined in claim 1 in which the segments are made of flexible plastic material and the means for articulating the segments together are very thin connecting members of plastic material.

* * * * *